US009816778B2

(12) United States Patent
Bardy et al.

(10) Patent No.: US 9,816,778 B2
(45) Date of Patent: Nov. 14, 2017

(54) HOLSTER FOR HANDGUN

(71) Applicant: Fobus International Ltd., Kfar Hess (IL)

(72) Inventors: Alex Bardy, Rishon Lizion (IL); Gal Halevi, Kiryat Ono (IL)

(73) Assignee: FOBUS INTERNATIONAL LTD., KFAR HESS (IL)

( * ) Notice: Subject to any disclaimer, the term of this patent is extended or adjusted under 35 U.S.C. 154(b) by 125 days.

(21) Appl. No.: 14/759,579

(22) PCT Filed: Jan. 6, 2014

(86) PCT No.: PCT/IL2014/050015
§ 371 (c)(1),
(2) Date: Jul. 7, 2015

(87) PCT Pub. No.: WO2014/108894
PCT Pub. Date: Jul. 17, 2014

(65) Prior Publication Data

US 2015/0345899 A1 Dec. 3, 2015

Related U.S. Application Data

(60) Provisional application No. 61/750,509, filed on Jan. 9, 2013.

(51) Int. Cl.
*F41C 33/02* (2006.01)

(52) U.S. Cl.
CPC ..... *F41C 33/02* (2013.01); *F41C 33/0236* (2013.01); *F41C 33/0272* (2013.01); *F41C 33/0254* (2013.01)

(58) Field of Classification Search
CPC F41C 33/045; F41C 33/0236; F41C 33/0245; F41C 33/0254; F41C 33/02; F41C 33/0272; Y10S 224/912
(Continued)

(56) References Cited

U.S. PATENT DOCUMENTS 3,008,617 A * 11/1961 Villwock ..... F41C 33/0209 224/183
4,035,902 A * 7/1977 Bianchi ..... F41C 33/0227 224/193

(Continued)

OTHER PUBLICATIONS

International Search Report and Written Opinion for International Application No. PCT/IL2014/050015 dated May 1, 2014.

(Continued)

*Primary Examiner* — Adam Waggenspack
(74) *Attorney, Agent, or Firm* — Dorsey & Whitney LLP

(57) ABSTRACT

A holster for a handgun comprising a holster body made of a substantially rigid and non-pliable material and configured for securely receiving a handgun therein. The holster body comprising a holster cavity configured for securely accommodating and partially embracing portions of the handgun, and a retention arrangement comprising a left-side trigger guard member and a right-side trigger guard member facing one another and configured for snug fitting within the handgun's trigger guard. At least one of the trigger guard members is a hinged trigger guard member, pivotally secured to the holster body.

19 Claims, 13 Drawing Sheets

(58) Field of Classification Search
USPC ..... 224/243–244
See application file for complete search history.

(56) References Cited

U.S. PATENT DOCUMENTS

| | | | | |
|---|---|---|---|---|
| 5,018,654 | A * | 5/1991 | Rogers | F41C 33/0227 224/244 |
| 5,129,562 | A * | 7/1992 | Bianchi | F41C 33/0227 224/244 |
| 5,211,322 | A * | 5/1993 | Nealy | B26B 29/025 224/230 |
| 5,810,221 | A * | 9/1998 | Beletsky | F41C 33/0227 224/244 |
| 6,267,279 | B1 * | 7/2001 | Matthews | F41C 33/0236 224/191 |
| 7,258,259 | B1 * | 8/2007 | Owens | A45F 5/02 224/192 |
| 7,841,497 | B1 | 11/2010 | Gregory et al. | |
| 8,235,263 | B1 | 8/2012 | Yeates et al. | |
| 8,720,755 | B2 * | 5/2014 | Gregory | F41C 33/0263 224/244 |
| 8,851,344 | B2 * | 10/2014 | Baumann | F41C 33/0263 224/192 |
| 2008/0272162 | A1 * | 11/2008 | Gamble | F41C 33/0227 224/243 |
| 2011/0174847 | A1 | 7/2011 | Crye | |

OTHER PUBLICATIONS

Fobus holsters "Fobus EM Series—Tactical Holsters", published on Sep. 22, 2012; available as of Dec. 28, 2015 https://www.youtube.com/watch?v=liRgU7RTZBA.

Fobus holsters "Fobus Tactical Holsters—EM Series" published on May 8, 2012; available as of Dec. 28, 2015 https://www.youtube.com/watch?feature=player_embedded&v=AnbpZv-hC4E.

Fobus holsters & pouches "Fobus EM17: Glock 17/22 Pistol Holster" 4 pages; retrieved Feb. 11, 2015.

* cited by examiner

HOLSTER FOR HANDGUN

TECHNOLOGICAL FIELD

The presently disclosed subject matter is concerned with a holster for a handgun. More particularly, the holster is of the type configured for securely retaining a hand gun yet facilitating its fast drawing also at an upwards direction and also at the event that the firearm is configured with a tactical accessory.

BACKGROUND

Holsters for carrying handguns are well known in the art and are generally designed for comfortable carrying of a handgun by a user, while protecting the handgun and holding it securely. Holsters should provide quick and easy drawing of the handgun therefrom on one hand, while assuring that when not in use, the handgun will remain safely in the holster, on the other hand.

Holsters can be worn by the user in many positions and configurations, for example over a top rim of an individual's trousers, waist belt, a combat vest, etc.

One example of a holster for carrying a handgun can be found in U.S. Pat. No. 8,235,263, which discloses a holster for a handgun, comprising a holster body defining a cavity for receiving and holding a handgun; a retention guard pivotably coupled to the body, wherein the retention guard is pivotable between a closed position for securing a handgun within the cavity and an open position for removal of the handgun; and a guard release lever for releasably securing the retention guard in the closed position, wherein the guard release lever is biased to a guard retention position, but wherein the guard release lever is capable of being pivoted to a guard release position when a user's thumb/finger applies a pivoting force to the thumb/finger engagement portion such that the guard locking portion is sufficiently withdrawn from the guard locking means to allow the retention guard to pivot to the open position.

U.S. Pat. No. 7,841,497 also discloses a holster for a handgun. The holster having an axis that separates a frame/slide portion of the holster from a trigger guard portion of the holster and a lever having a finger button end and an engagement end, wherein the engagement end of the lever includes a locking portion protruding from a second side of the engagement end, wherein the lever is pivotally attached to a side wall of the holster, along the axis, approximately between the finger button end and the engagement end, such that the finger button end extends into the frame/slide portion of the holster and the engagement end extends into the trigger guard portion of the holster, wherein the lever is pivotable between an engaged position and a disengaged position, and wherein, when the lever is in the engaged position, the locking portion protrudes into a holster cavity, via an opening in the side wall.

GENERAL DESCRIPTION

The holster subject of the present disclosure is configured for securely retaining a handgun, yet facilitating fast drawing of the handgun, also at a top-draw, and also when the handgun is fitted with an under-mount tactical accessory.

The term handgun denotes any hand carried weapon typically carried by individuals at a hip or otherwise mounted holster, e.g. pistols and the like;

The term top-draw as used herein in the specification and claims denotes drawing a firearm at an upwards direction, i.e. substantially along a longitudinal axis of the firearm (along a longitudinal axis of the barrel). As opposed to top-draw, backward-draw (slant-draw) requires an individual to first detach the handgun from the holster (in a pitch-like fashion, i.e. tilt it about a longitudinal axis of the handgun) and then draw; it is appreciated by professionals that the top-draw is considered a faster draw, and more instinctive, than a backward-draw.

The term tactical accessory denotes any accessory used in conjunction and attached to a handgun, such as a laser pointer, illuminator, glass braking device, stunning device and the like;

The term under-mount tactical accessory as used herein in the specification and claims denotes mounting of any tactical accessory to the handgun, fixedly or detachably-attachable, however under the barrel. Such mounting is typically facilitated by a mounting rail, often referred to as a 'light rail' or a 'Picatinny rail', 'tactical rail' or a 'universal rail', etc.;

According to the disclosed subject matter there is provided a holster for a handgun, said holster comprising a holster body made of a substantially rigid and non-pliable material and configured for securely receiving a handgun therein, said holster body comprising a holster cavity configured for securely accommodating and partially embracing at least a portion of the handgun, and a retention arrangement comprising a left-side trigger guard member and a right-side trigger guard member facing one another and configured for snug fitting within the handgun's trigger guard, wherein at least one of said trigger guard members is a hinged trigger guard member, pivotally secured to the holster body.

The hinged trigger guard member is pivotally restricted between a retaining position (i.e. a closed position) and a tilted position (i.e. an open position). At the retaining position the hinged trigger guard member bears within and/or over at least portions of the trigger guard, thus securely retaining the handgun, and at the tilted position the hinged trigger guard member is displaced to facilitate drawing the handgun (also when a tactical accessory is mounted at an under-mount configuration);

The holster further comprises a mounting unit for mounting the holster at any one or more mounting positions and configurations, e.g. hip mounting the holster over a top rim of an individual's trousers, skirt and the like (outside the waist band), over a belt, a combat vest, or attaching to an ankle of the individual, etc., at a concealed or noticeable fashion.

Any one or more of the following properties, designs, features and configurations can be associated with the holster subject of the presently disclosed subject matter, separately or in combinations:

- The holster body is made of a plastic molded material;
- The cavity of the holster body is configured with inner shape complimentary to the configuration of outer sections of the handgun to be placed in the holster. Typically the holster cavity embraces a slide and fore frame portion of the handgun;
- The left-side trigger guard member and a right-side trigger guard member are rigid, substantially non-pliable elements;
- A trigger guard retaining arrangement is provided, for retaining the left-side trigger guard member and a right-side trigger guard member at their retaining position, so as to secure the handgun within the holster and avoid an unintended draw;
- The trigger guard retaining arrangement can be one or more security straps configured to tighten the left-side trigger guard member and the right-side trigger guard member at their respective retaining positions;

A security strap can extend from the left-side trigger guard member to the right-side trigger guard member and be configured with a fast release/opening closure;

The security strap extends between a fixed body portion of the holster and the hinged trigger guard member;

The security strap can be detachable/removable;

The trigger guard retaining arrangement can be a biasing mechanism such that the hinged trigger guard member is spring biased into the retaining position, i.e. in a normally retaining position;

Inner surfaces of one or both of the left-side trigger guard member and the right-side trigger guard member are contoured for arresting within boundaries of the handgun's trigger guard;

Inner surfaces of one or both of the left-side trigger guard member and the right-side trigger guard member are configured with laterally inward facing projections for arresting within boundaries of the handgun's trigger guard;

The one or both of the left-side trigger guard member and the right-side trigger guard member are configured for clamping at least portions of the handgun's trigger guard;

A fore edge of one or both the left-side trigger guard member and the right-side trigger guard member is configured with a chamfered gliding surface, to thereby facilitate displacement of the hinged trigger guard member into the tilted position, namely the open position, allowing an upwards draw;

Extending under the hinged trigger guard member there can be a partial trigger guard bracing member, fixedly extending from a rigid portion of the rigid holster body, and supporting the hinged trigger guard member;

The hinged trigger guard member is pivotally attached to the body portion by an integral hinge portion (at times referred to as a 'live hinge');

The holster body can further comprise a non-marring positioning plunger configured for engagement within the barrel muzzle of the handgun;

The mounting unit of the holster can be configured with a paddle portion;

The paddle portion can be fixed or rotatable between one or more angular positions;

The mounting unit of the holster is detachably attachable to the holster;

The mounting unit of the holster is modular and configured for use in different ways;

The holster is configured with a secure mechanism requiring proactive unlocking to allow a draw;

The hinged trigger guard member is pivotal about a pivot axis extending substantially parallel to a longitudinal axis of the holster body, the latter extending substantially parallel to a longitudinal axis of the handgun (typically extending through its barrel);

The hinged trigger guard member can be pivotally articulated to the holster body about two or more axes, however wherein the retaining position and a tilted position are kept.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1:
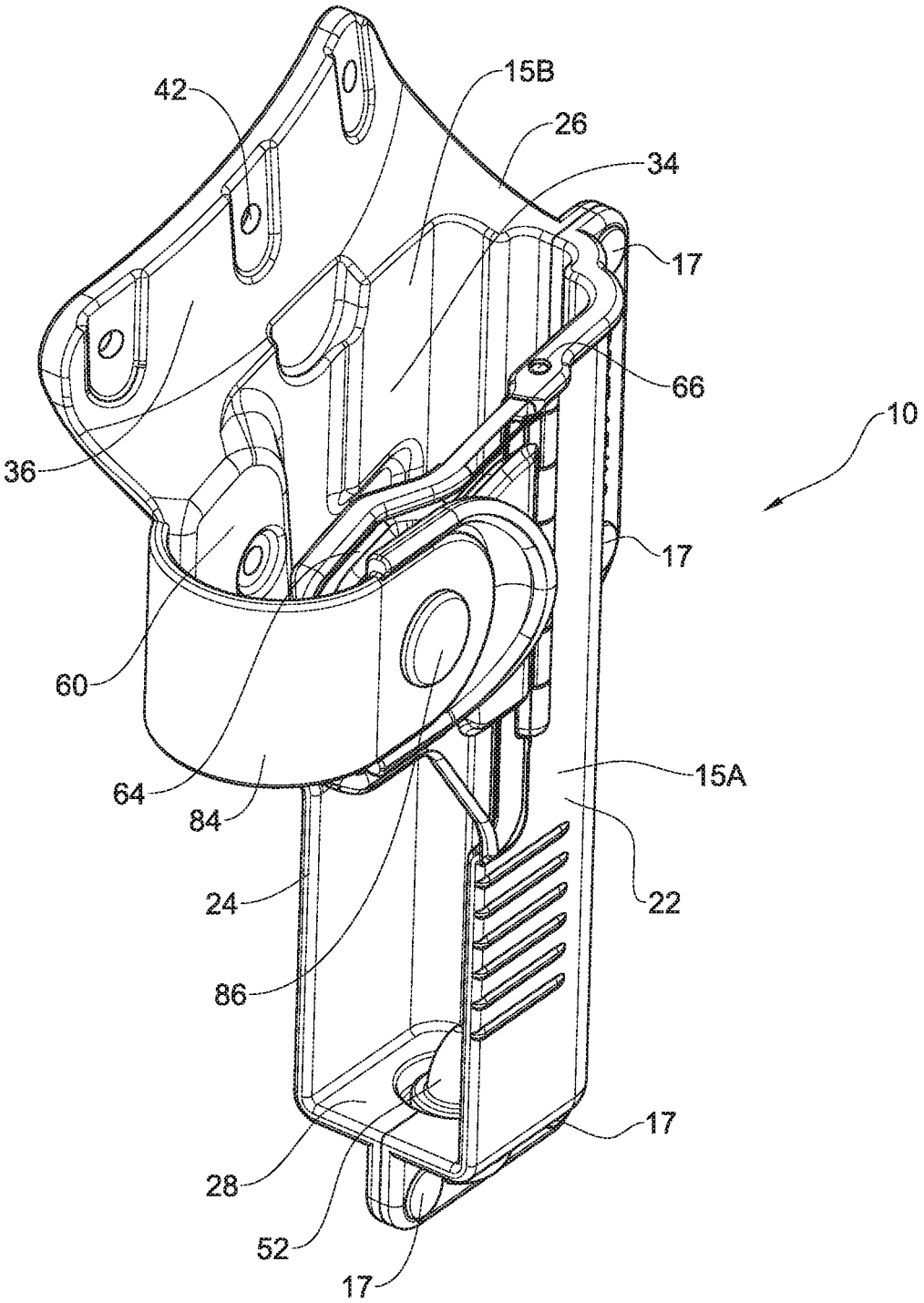
FIG. 1 is a bottom rear perspective view of a holster according to the disclosed subject matter.

Attention is directed to the drawings illustrating a holster generally designated 10, configured for securing a handgun 20. The holster 10 is made of a rigid and non-pliable material, e.g. made of molded plastic material.

The holster 10 has a holster body configured with a right side wall 22, a left side wall 24, a top wall 26 and a front wall 28, extending substantially at right angles with respect to one another and defining together a cavity 34, the inside walls of which being configured with a shape complimentary to the configuration of outer sections of the handgun 20 to be placed in the holster 10. The holster cavity 34 defines a longitudinal axis (parallel or coextending with a longitudinal axis of the handgun extending through its barrel).

In the present example the holster 10 is composed of a right shell member 15A and a left shell member 15B fixedly articulated to one another along a front and top perimeter by a plurality of fasteners 17.

The left shell member 15B has a mounting portion 36 extending backwards and configured for attaching thereto a mounting unit (not shown; for example attachable to the mounting portion 36 by fasteners 42), fixedly attached to the holster body by fasteners 42. A holster mounting paddle (not shown) is detachably attachable to the mounting unit, for mounting the holster at various positions and configurations. e.g. hip mounting the holster over a top rim of an individual's trousers, skirt and the like, over a belt, a combat vest, or attaching to an ankle of the individual, etc., at a concealed or noticeable fashion. The mounting paddle is articulated to the mounting unit through an angle setting mechanism (not shown), facilitating relative angular orientation between the mounting paddle and the holster body, and fixedly retained at any of a plurality of angular positions, by a setting screw (not shown).

The holster cavity 34 is configured, as far as shape and size, in conformity with at least portions of the handgun 20, such that when the handgun is received within the holster 10 at least a front portion of the handgun's slide 11A and fore frame portion 11B are at least partially embraced by the holster 10.

According to a particular example, the holster is designated for accommodating a particular handgun model, so as to ensure adequate fit embracing of the handgun within the holster.

The holster body is further configured with a non-marring positioning plunger 52 extending within the cavity 34 from an inside face of the front wall 28 and extending substantially coaxial with a longitudinal axis of the holster, configured for engagement within the barrel muzzle 54 of the handgun 20. The positioning plunger 52 has a tapering cross-section for easy draw/mount of the handgun.

As can further be seen in the drawings, the holster 10 is further configured with a handgun retention arrangement comprising of a right-side trigger guard member 60 and a left-side trigger guard member 64, facing one another, both being rigid, substantially non-pliable elements.

In the present example the left-side trigger guard member 60 integrally extends at a rear, bottom portion of the left shell member 15B, whilst the right-side trigger guard member 64 is a hinged trigger guard member i.e. it is pivotally secured at a rear, bottom portion of the right shell member 15A to the holster body.

Figure 2A:
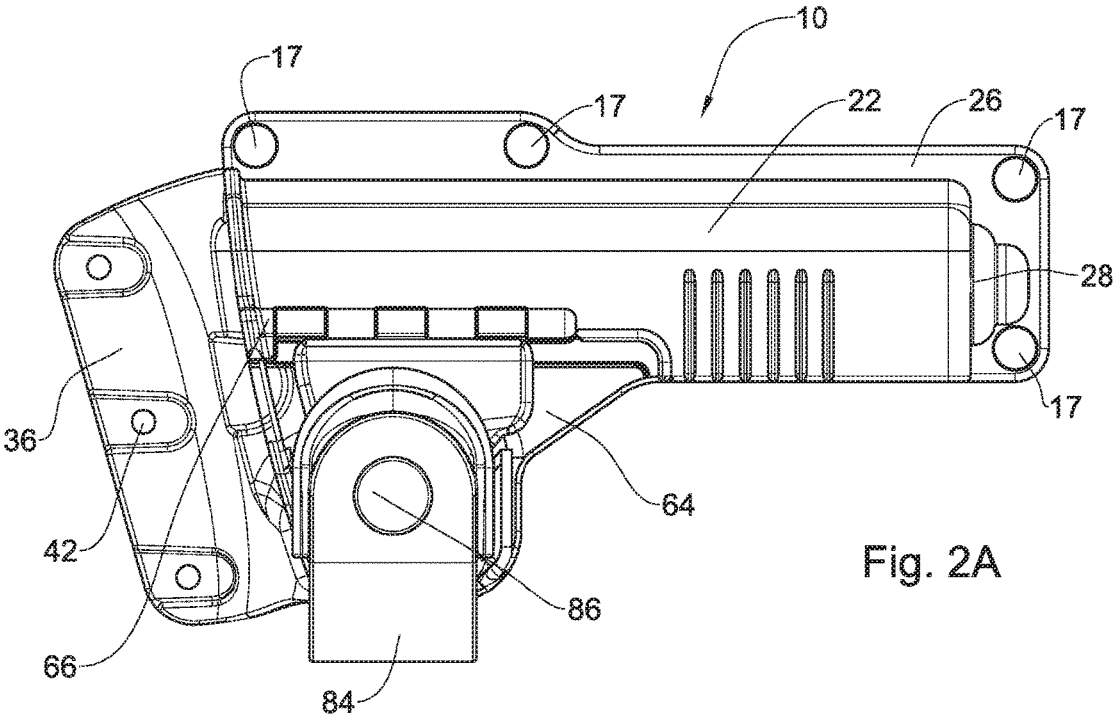
FIG. 2A is a side view of the holster seen in FIG. 1.
Figure 2B:
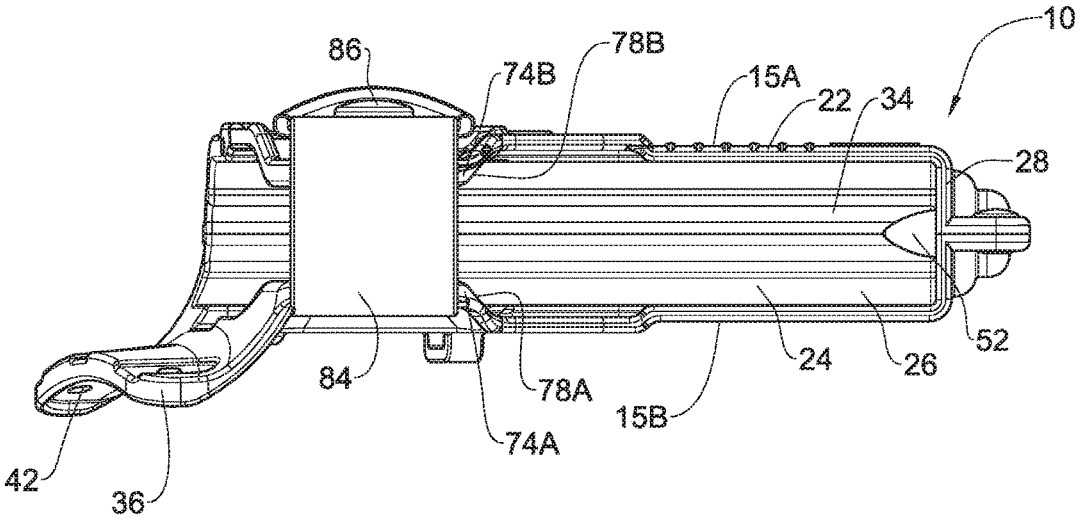
FIG. 2B is a bottom view of the holster seen in FIG. 1.
Figure 2C:
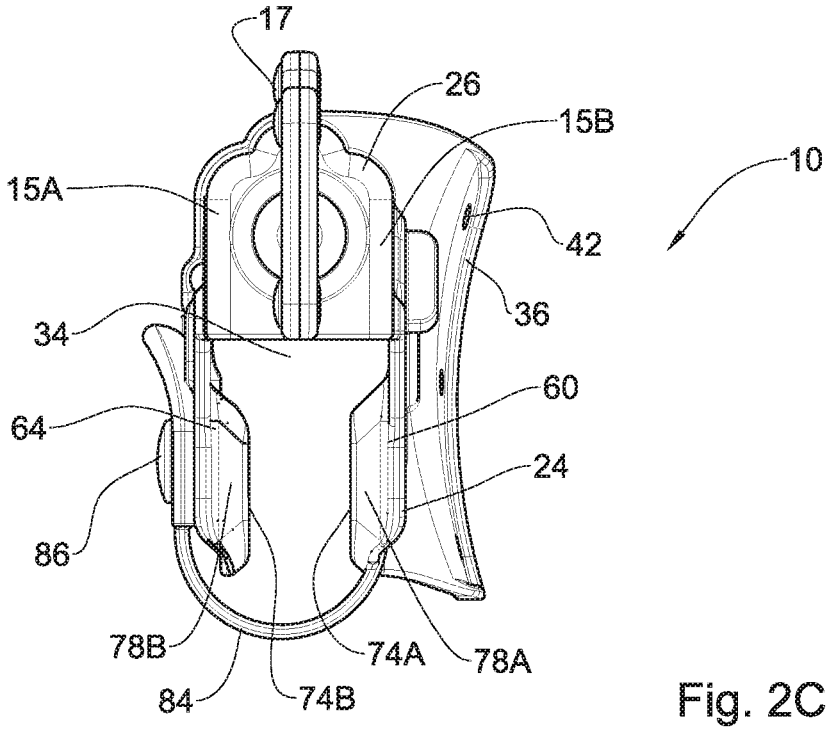
FIG. 2C is a front view of the holster seen in FIG. 1.
Figure 2D:
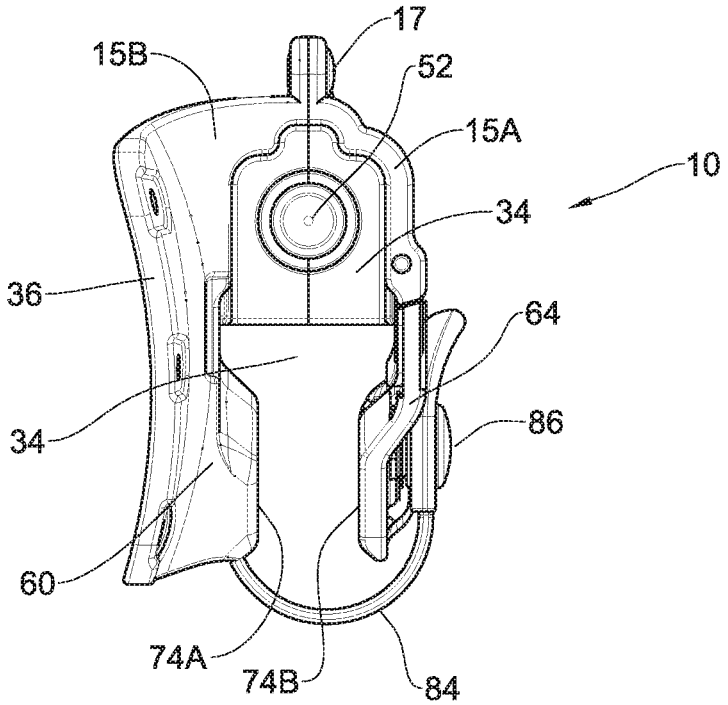
FIG. 2D is a rear view of the holster seen in FIG. 1.
Figure 3A:
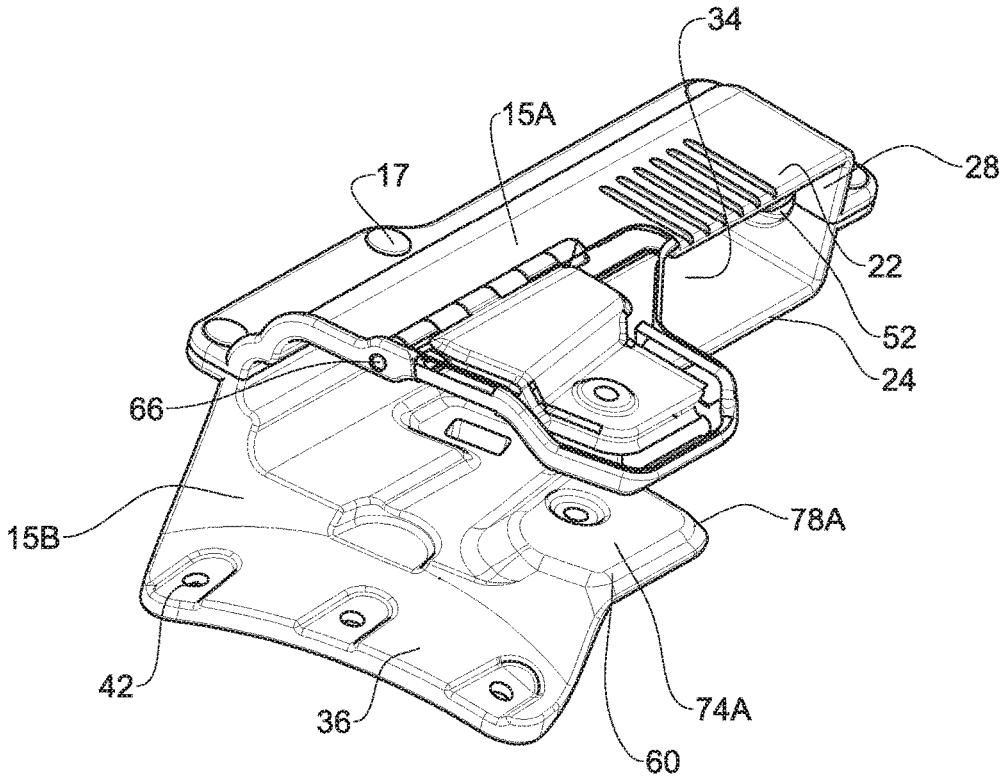
FIG. 3A is a rear perspective view of the holster, however with a security strap detached therefrom.
Figure 3B:
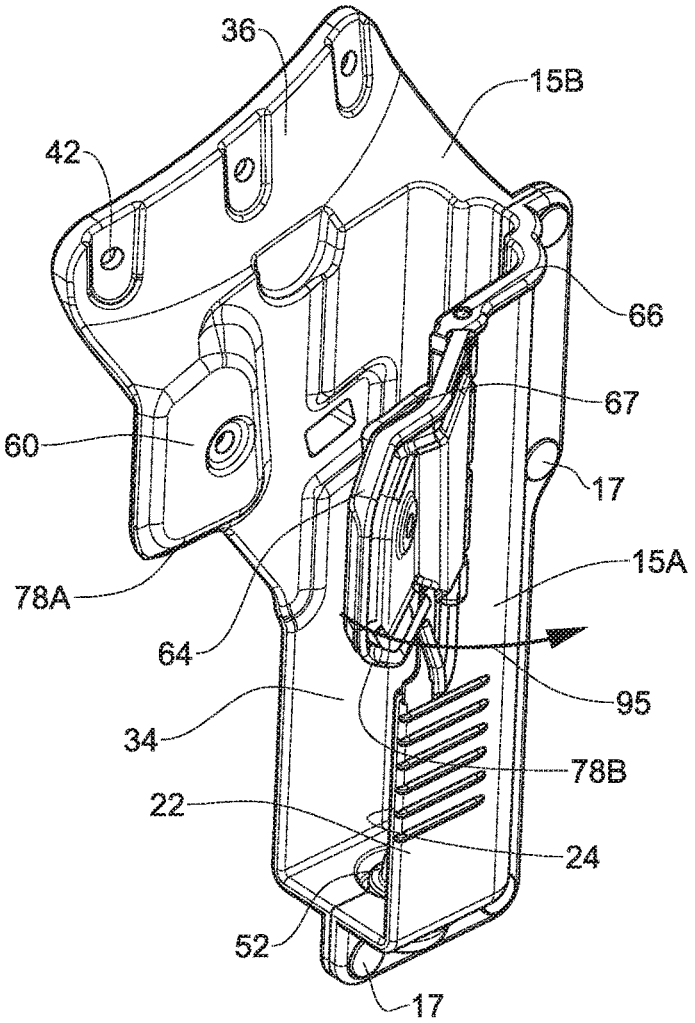
FIG. 3B is a bottom perspective view FIG. 3A.
Figure 3C:
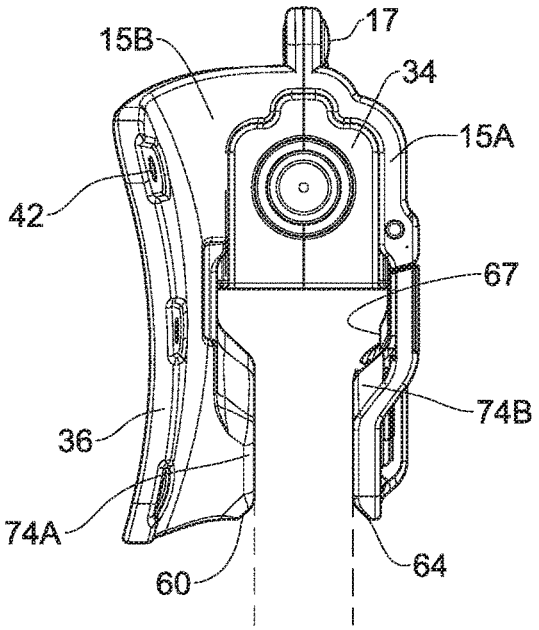
FIG. 3C is a rear view of FIG. 3A.
Figure 4B:
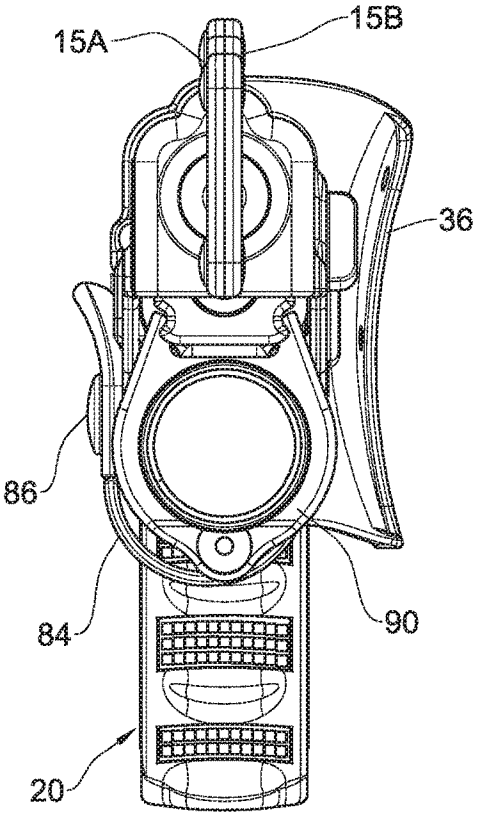
FIG. 4B is a front view of the holster seen in FIG. 4A.
Figure 4A:
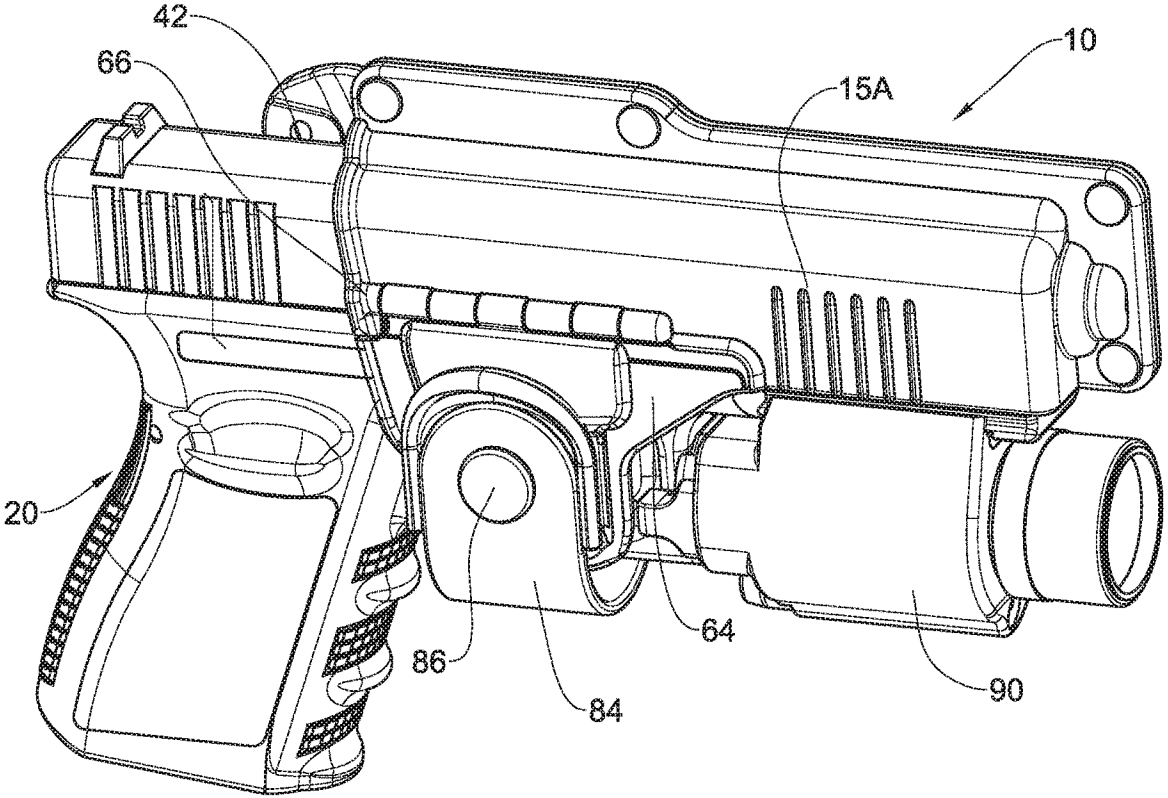
FIG. 4A is a front perspective view of the holster, accommodating a handgun fitted with a tactical accessory.
Figure 5A:
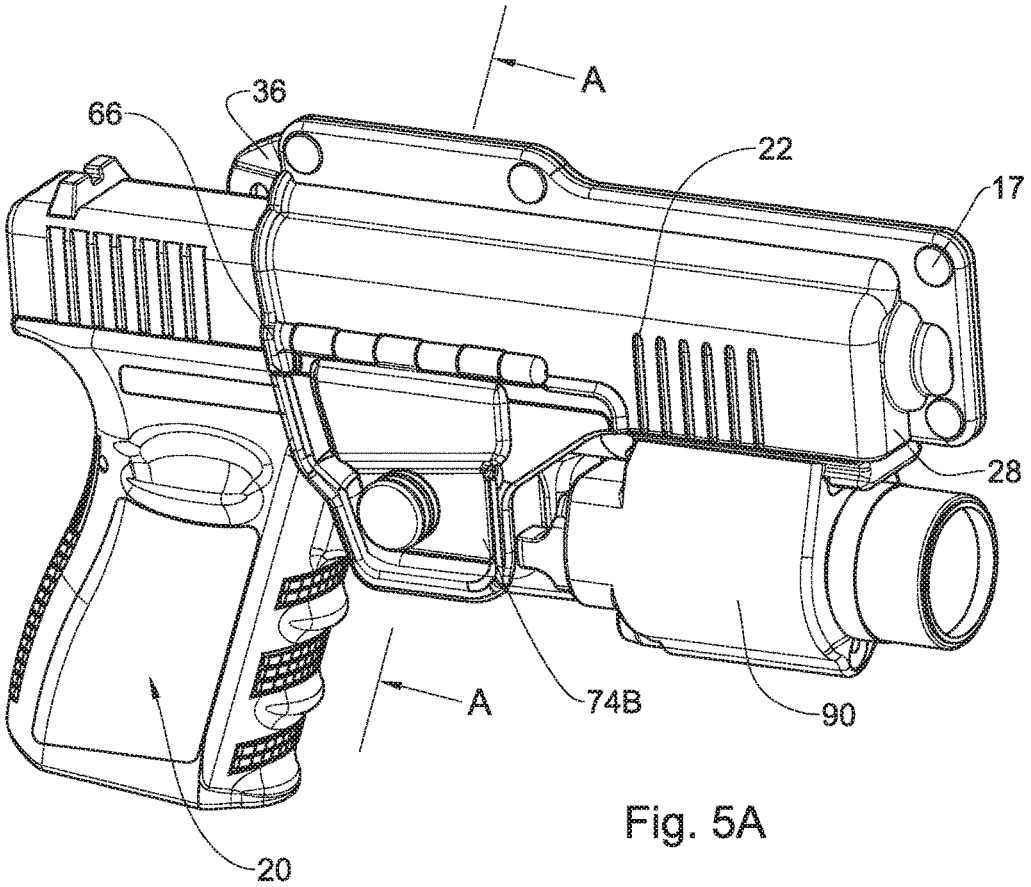
FIG. 5A is a front perspective view of the holster, accommodating a handgun fitted with a tactical accessory, however with a security strap detached therefrom.
Figure 5B:
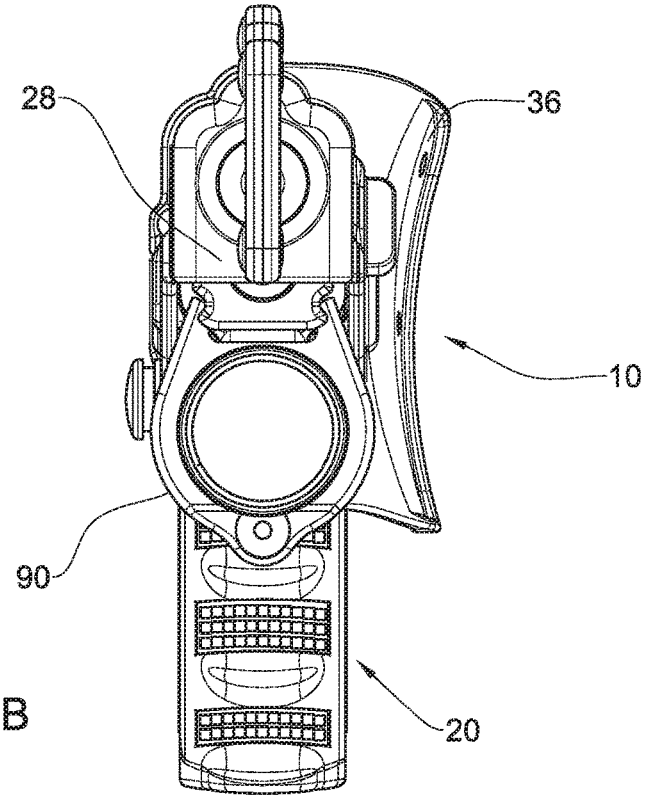
FIG. 5B is a front view of FIG. 5A.
Figure 5C:
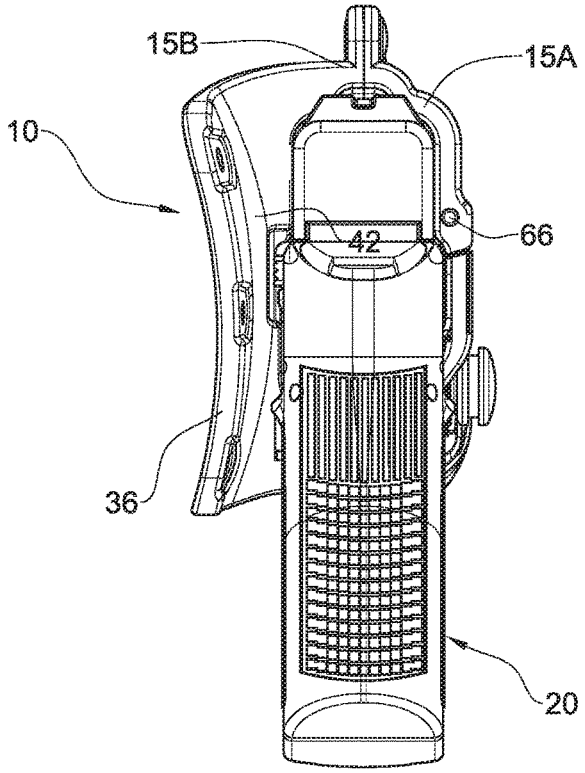
FIG. 5C is a rear view of FIG. 5A.
Figure 6:
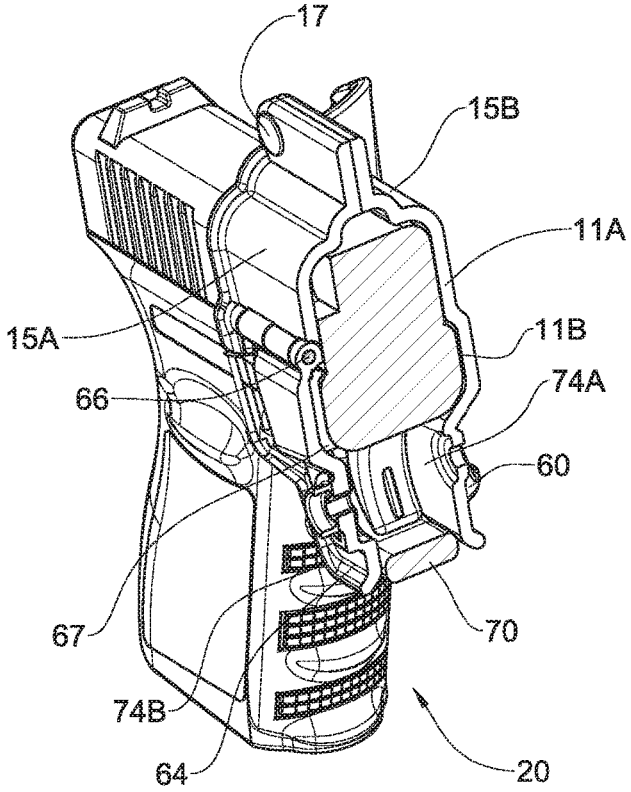
FIG. 6 is a section taken along line A-A in FIG. 5A.
Figure 7A:
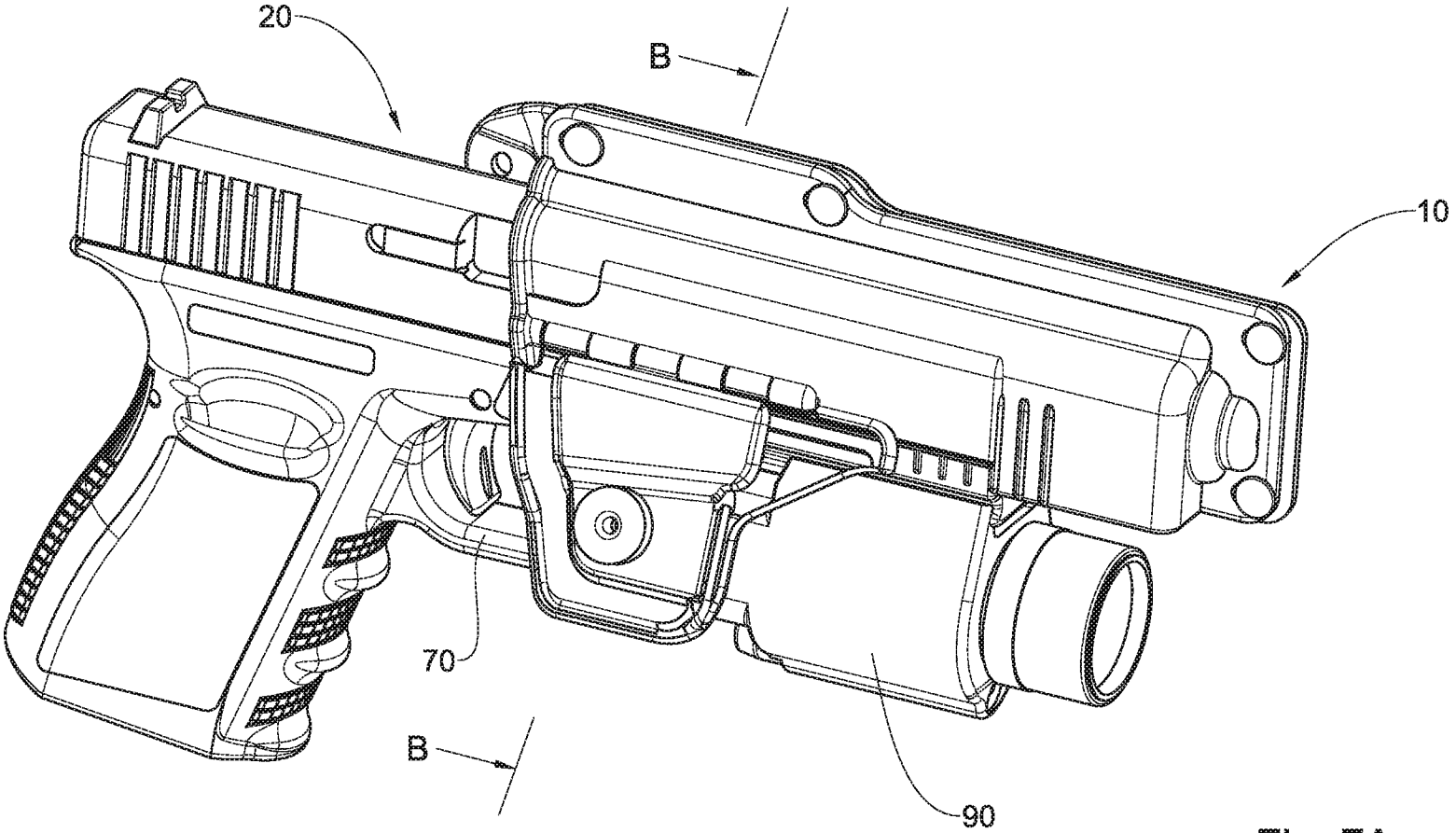
FIG. 7A is a perspective view illustrating a first sequence of drawing the handgun from the holster, the security strap detached therefrom.
Figure 7B:
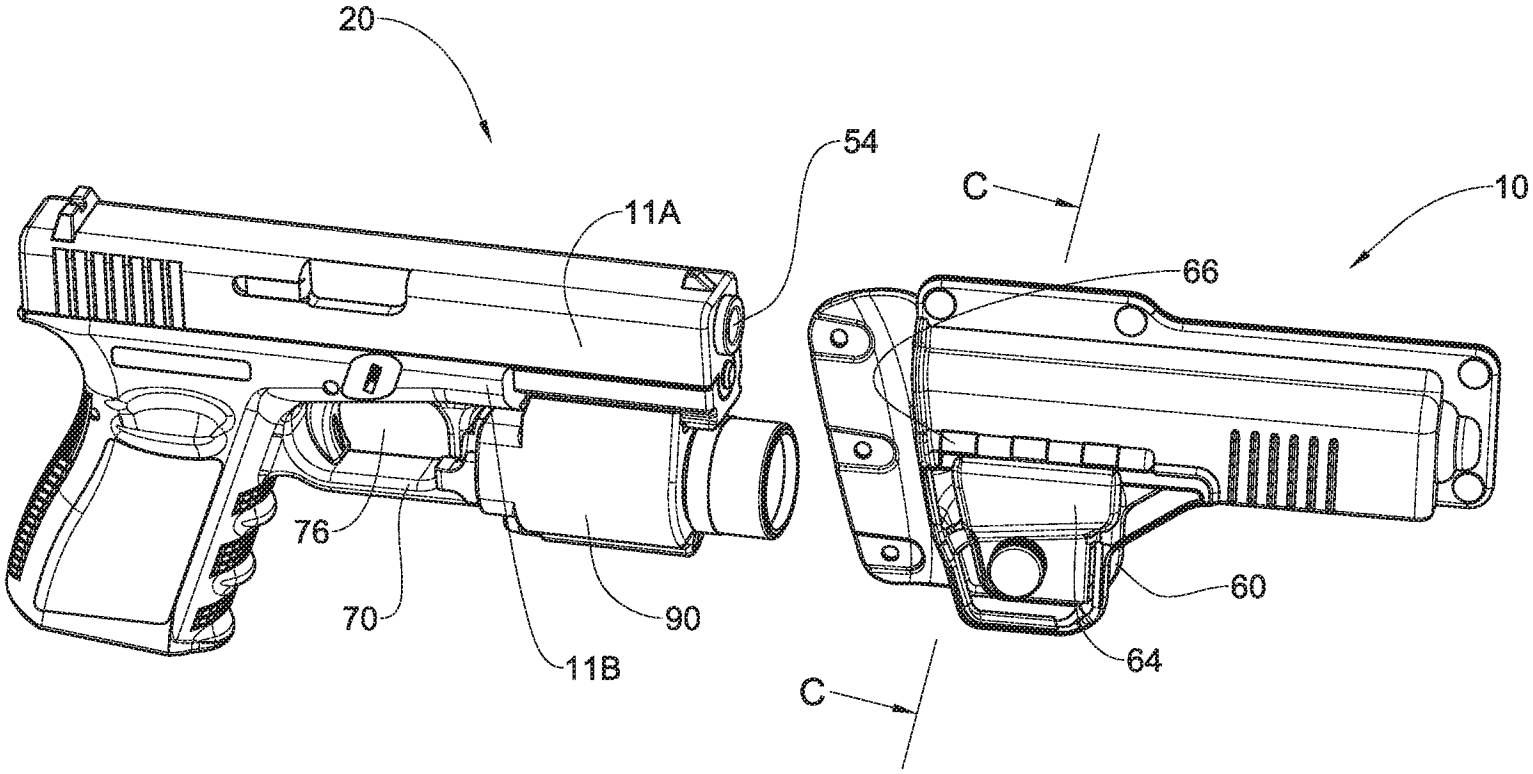
FIG. 7B is a perspective view illustrating a the handgun after drawing from the holster, the security strap detached therefrom.
Figure 8A:
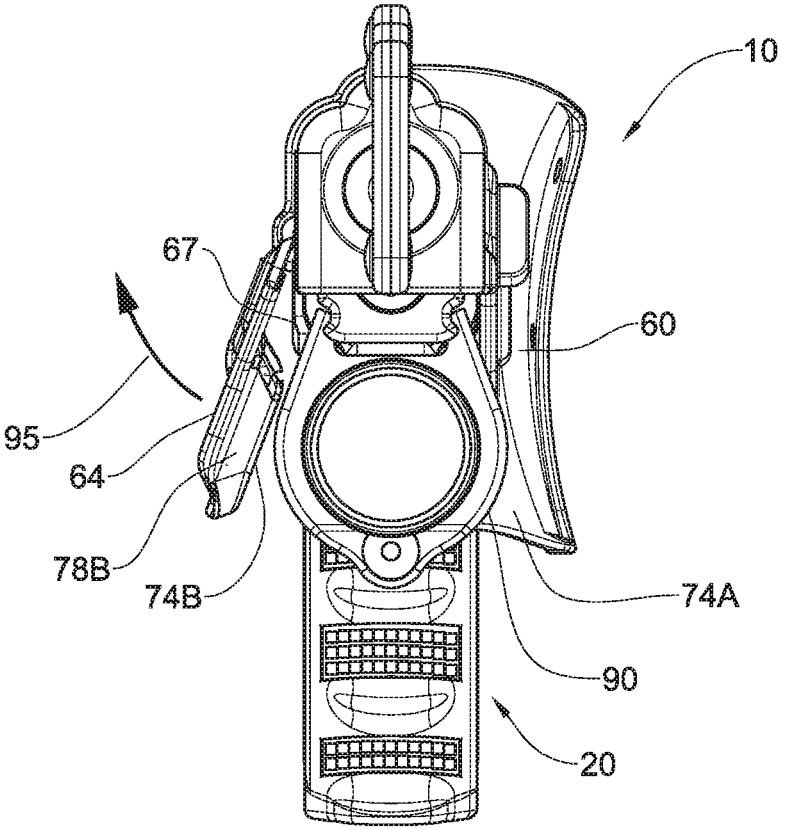
FIG. 8A is a front view of FIG. 7A.
Figure 8B:
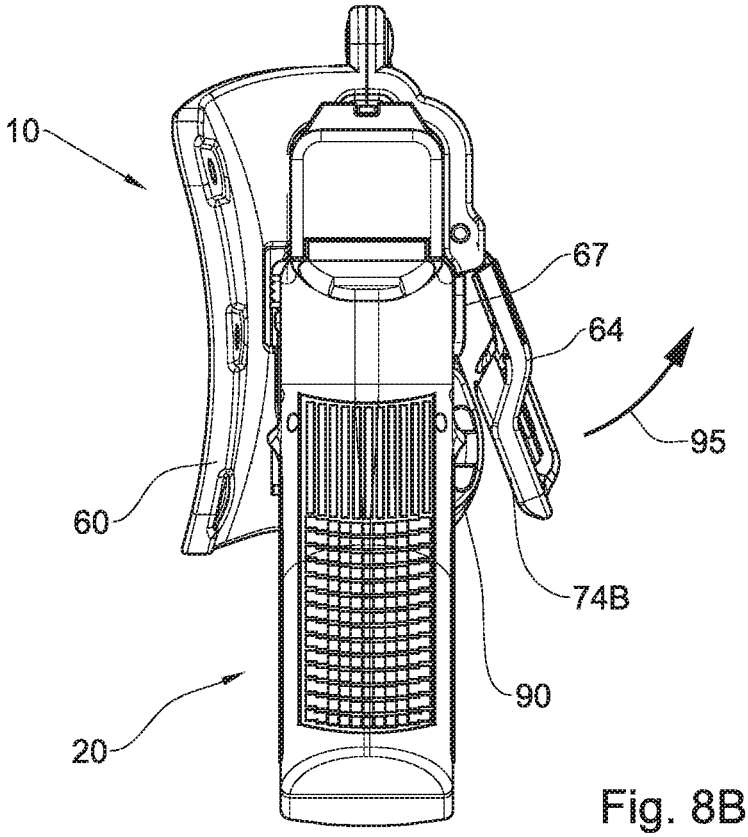
FIG. 8B is a rear view of FIG. 7A.
Figure 9A:
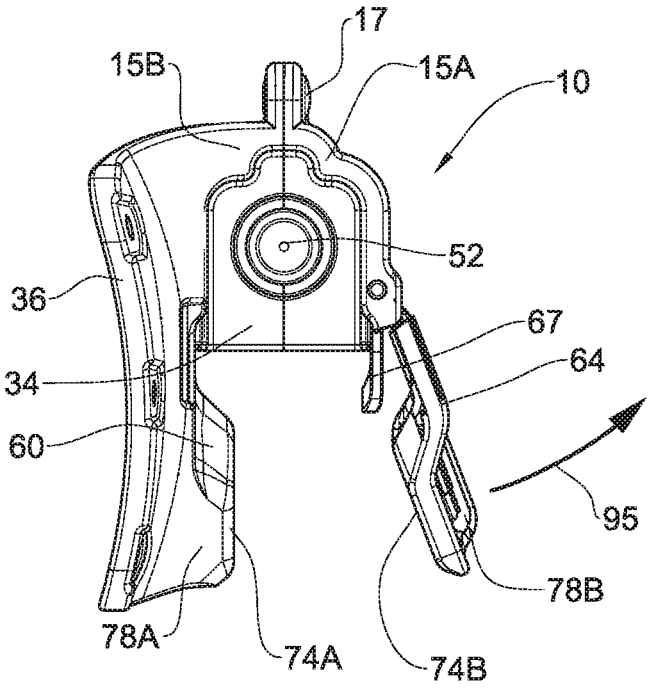
FIG. 9A is a rear view of the holster at a drawing position, however without a handgun and with the security strap detached therefrom.
Figure 9B:
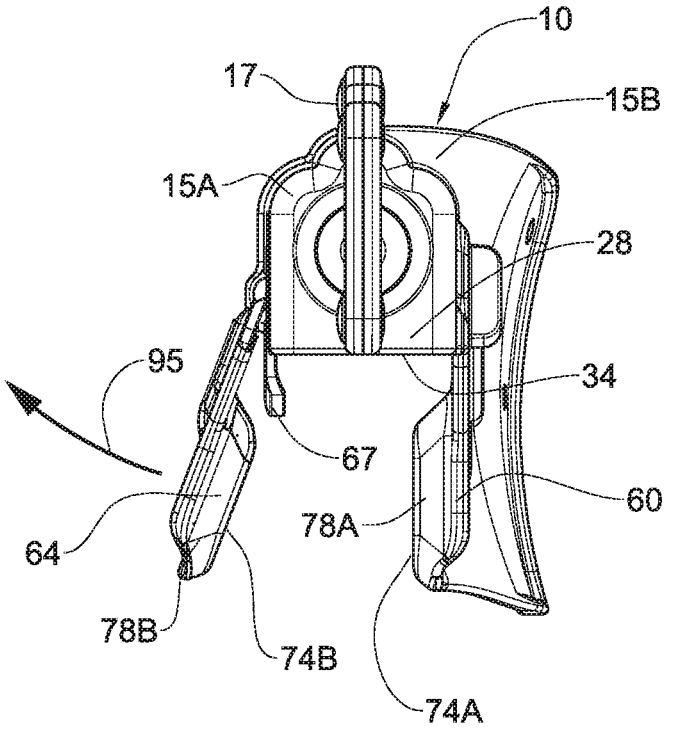
FIG. 9B is a front view of FIG. 9A.
Figure 9C:
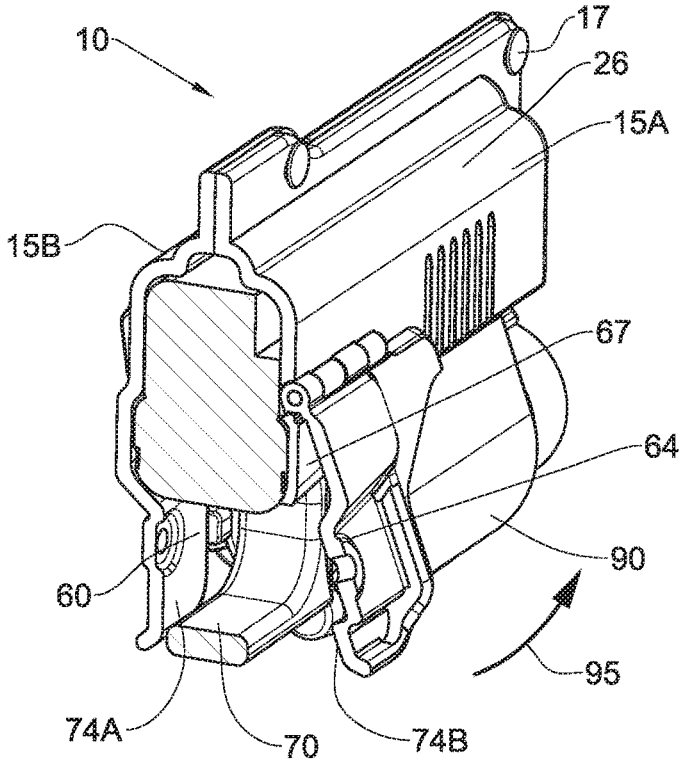
FIG. 9C is a section along line B-B in FIG. 7A.
Figure 9D:
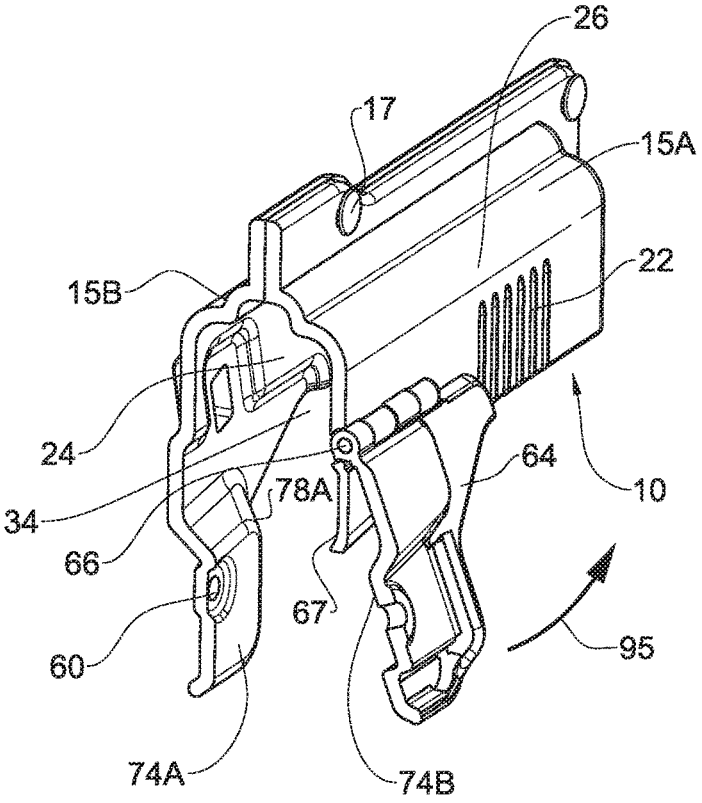
FIG. 9D is a section along line C-C in FIG. 7C.

The hinged trigger guard member 64 is pivotally secured to the right shell member 15A about axis 66 extending substantially parallel to the longitudinal axis of the holster 20. The hinged trigger guard member 64 is pivotally restricted between a retaining position (i.e. a closed position; best seen in FIGS. 1, 2B, 2C, 2D, 3A, 3C, 6 and 9C), and a tilted position (i.e. an open position; best seen in FIGS. 3B, 8A, 8B, 9A, 9B, 9C and 9D). As seen in the drawings, at the retaining position, the hinged trigger guard member 64 extends substantially parallel to the left-side trigger guard member 60.

At the retaining position the hinged trigger guard member 64 bears over a rigid support member 67 (best seen in FIGS. 3B, 8A, 8B, 9A, 9B, 9C and 9D), configured as a plate member coextensive with an inside surface of the right wall 22 and participating in supporting the handgun.

The handgun retention arrangement is such that the left-side trigger guard member 60 and a right-side trigger guard member 64 are configured for bearing within and/or over at least portions of the trigger guard 70 of the handgun 20, thus securely retaining the handgun 20, whilst at the tilted/open position, the hinged trigger guard member 64 is displaced to facilitate easy drawing the handgun (also when a tactical accessory is mounted at an under-mount configuration), as will be discussed herein below. Thus, both the left-side trigger guard member 60 and the right-side trigger guard member 64 are configured with a laterally inwardly directed projecting bulge 74A and 74B, respectively, shaped and sized such that at the retaining/closed position, the bulges 74A and 74B extend into the space 76 defined by the trigger guard 70. Other portions of the left-side trigger guard member 60 and the right-side trigger guard member 64 bare over respective portions of the trigger guard 70. Depending on the retention force, the left-side trigger guard member 60 and the right-side trigger guard member 64 are configured for clamping the trigger guard 70 of the handgun 20.

Further noted, the projecting bulges 74A and 74B are configured with a front, a chamfered gliding surface 78A and 78B, respectively, to thereby facilitate displacement of the hinged trigger guard member into the tilted position, namely the open position, allowing a top draw. The gliding surface serve both for positioning the bulges within the trigger guard space 76 and for sliding engagement in a cam-follower like fashion upon drawing a handgun fitted with a tactical accessory, thereby facilitate displacement of the hinged trigger guard member into the tilted position, namely the open position, allowing a draw, as will be discussed herein after.

A trigger guard retaining arrangement is provided, for retaining the left-side trigger guard member 74A and a right-side trigger guard member 74B at their closed, retaining position, so as to secure the handgun 20 within the holster cavity 34 and avoid an unintended draw. According to one particular configuration the trigger guard retaining arrangement is a security strap 84 configured to tighten the left-side trigger guard member 60 and a right-side trigger guard member 64 at their respective retaining position. For that purpose the security strap 84 is secured at one end thereof to a fixed portion at the right shell member 15A and is detachably articulated to the right-side trigger guard member 64 by a fast release/opening closure (snap closure) 86. According to a modification of the disclosure, the security strap 80 can be detachable/removable at both ends thereof. At a closed position of the security strap 84, namely when it is engaged at both ends thereof with the respective left-side trigger guard member 60 and a right-side trigger guard member 64, it prevents the hinged trigger guard member 64 from displacing into its tilted/open position.

In use, it is often required to fit a handgun 20 with a tactical accessory 90, e.g. a laser pointer, illuminator, glass braking device, stunning devise and the like. Such accessories typically have a diameter exceeding that of the handgun and thus special arrangements are required to facilitate a so-called top-draw, i.e. drawing the handgun from the holster 10 about an imaginary line coaxial to the longitudinal axis of the handgun. To facilitate same, the holster 10 subject of the present disclosed subject matter is configured with said hinged trigger guard member 64, whereupon releasing the security strap 84 and drawing the handgun 20 along the longitudinal axis thereof, a rear portion of the tactical accessory 90 encounters the front chamfered gliding surfaces 78A and 78B of the right-side trigger guard member 64 and a left-side trigger guard member 60, respectively, resulting in biasing displacing of the hinged trigger guard member 64 into the tilted position, namely the open position, as illustrated by arrowed line 95, allowing a fast and smooth top-draw, i.e. without interruption of the right-side trigger guard member 64 and a left-side trigger guard member 60.

Inserting the handgun 20 fitted with the tactical accessory 90 back into the holster takes place in a reverse sequence of operation, or at a slanted fashion (i.e. first inserting the muzzle end 54 of the handgun and placing it over the positioning plunger 52, and then tilting the handgun 20 into the cavity 34, in reverse back draw fashion) and securing it in place by the security strap 84.

It is appreciated that the holster subject of the present disclosure can be configured at different modifications, without departing from the spirit and scope of the present disclosure, mutatis mutandis, and however not illustrated.

For example, the hinged trigger guard member can be pivotally articulated to the holster body about two or more axes, however wherein the retaining position and a tilted position are kept. The tilting displacement can take place about an axis substantially parallel to the longitudinal axis, or not.

Furthermore, the hinged trigger guard member can be pivotally attached to the body portion by an integral hinge portion (at times referred to as a 'live hinge'), rather than an axis as disclosed hereinabove.

Yet, the trigger guard retaining arrangement can be a biasing mechanism such that the hinged trigger guard member can be spring biased into the retaining position, i.e. in a normally retaining position.

Even more so, the holster can be configured with a secure mechanism requiring proactive unlocking to allow a draw. Such a secure mechanism can be any protruding element extending into the trigger guard and requiring its retraction to facilitate a draw.

The invention claimed is:

1. A holster for a handgun, the holster comprising:

a holster body made of a rigid material, the holster body configured for securely receiving a handgun therein, the holster body including a holster cavity configured for securely accommodating and partially embracing portions of the handgun;

a retention arrangement including a left-side trigger guard member and a right-side trigger guard member that are facing one another and are configured for snug fitting within the handgun's trigger guard, wherein at least one of the left-side trigger guard member or the right-side trigger guard member is a hinged trigger guard member that is pivotally secured to the holster body, one or both the left-side trigger guard member and the right-side trigger guard member includes a fore edge configured with a chamfered gliding surface to facilitate displacement of the hinged trigger guard member into a tilted position during drawing of the handgun; and a rigid support member fixedly extending from the holster body between the hinged trigger guard member and the holster cavity, the rigid support member having an inner surface configured for at least partially bearing against an outer portion of the handgun.

2. The holster according to claim 1, wherein the hinged trigger guard member is pivotally movable between a retaining position and a tilted position; wherein, at the retaining position, the hinged trigger guard member bears within and/or over at least portions of the trigger guard, thus securely retaining the handgun.

3. The holster according to claim 1, wherein the holster cavity of the holster body is configured with an inner shape complimentary to a configuration of outer sections of the handgun to be placed in the holster.

4. The holster according to claim 1, wherein the holster cavity is configured to embrace a slide and fore frame portion of the handgun.

5. The holster according to claim 1, wherein the left-side trigger guard member and the right-side trigger guard member are rigid elements.

6. The holster according to claim 1, further comprising a trigger guard retaining arrangement configured for retaining the left-side trigger guard member and the right-side trigger guard member at respective retaining positions thereof, so as to secure the handgun within the holster and avoid an unintended draw.

7. The holster according to claim 1, further comprising a trigger guard retaining arrangement configured for retaining the left-side trigger guard member and the right-side trigger guard member at respective retaining positions thereof, the trigger guard retaining arrangement including a biasing mechanism such that the hinged trigger guard member is spring biased into the retaining position.

8. The holster according to claim 1, further comprising a trigger guard retaining arrangement configured for retaining the left-side trigger guard member and the right-side trigger guard member at respective retaining positions thereof, the trigger guard retaining arrangement including one or more security straps configured to tighten the left-side trigger guard member and the right-side trigger guard member at the respective retaining positions thereof.

9. The holster according to claim 1, further comprising a security strap extending from the left-side trigger guard member to the right-side trigger guard member and is configured with a fast release/opening closure.

10. The holster according to claim 1, further comprising a security strap extending from the left-side trigger guard member to the right-side trigger guard member, the security strap extending between a fixed body portion of the holster and the hinged trigger guard member.

11. The holster according to claim 1, wherein one or both of the left-side trigger guard member and the right-side trigger guard member are configured for clamping at least portions of the handgun's trigger guard.

12. The holster according to claim 1, wherein the holster body includes a non-marring positioning plunger configured for engagement within a barrel muzzle of the handgun.

13. The holster according to claim 1, wherein the hinged trigger guard member is pivotal about a pivot axis extending parallel to a longitudinal axis of the holster body.

14. The holster according to claim 1, wherein the inner surface has a shape which is at least partially complementary to the shape of the outer portion of the handgun.

15. The holster according to claim 1, wherein the inner surface of the rigid member has a shape corresponding to a shape of a portion of the trigger guard member to which the inner surface faces.

16. The holster according to claim 1, wherein the rigid support member constitutes a portion of the holster body.

17. The holster according to claim 1, wherein at least a portion of the inner surface is shaped so as to mimic a shape of a corresponding portion of the handgun's trigger guard, so as to participate in the snug fitting within the handgun's trigger guard together with the right and left trigger guard members.

18. The holster according to claim 1, wherein the inner surface of the rigid support member is configured to participate in supporting the handgun.

19. The holster according to claim 1, wherein an outer surface of the rigid support member, opposite to the inner surface, is configured for facing the hinged trigger guard member.

* * * * *